United States Patent [19]

Notelteirs

[11] Patent Number: 4,495,436

[45] Date of Patent: Jan. 22, 1985

[54] ELECTRIC LAMP HAVING A LAMP CAP WHICH IS CONNECTED WITHOUT CEMENT

[75] Inventor: Victor R. Notelteirs, Eindhoven, Netherlands

[73] Assignee: U.S. Philips Corporation, New York, N.Y.

[21] Appl. No.: 394,737

[22] Filed: . Jul. 2, 1982

[30] Foreign Application Priority Data

Jul. 21, 1981 [NL] Netherlands ..... 8103436

[51] Int. Cl.[3] ..... H01J 5/48

[52] U.S. Cl. ..... 313/318; 313/578; 339/144 R

[58] Field of Search ..... 313/318, 578; 339/144 R

[56] References Cited

U.S. PATENT DOCUMENTS 4,371,807 2/1983 Eckhardt ..... 313/318

FOREIGN PATENT DOCUMENTS 0024060 2/1981 European Pat. Off. ..... 313/318
0024363 3/1981 European Pat. Off. .
2029093 3/1980 United Kingdom ..... 313/318

*Primary Examiner*—David K. Moore
*Assistant Examiner*—Vincent DeLuca
*Attorney, Agent, or Firm*—Robert S. Smith

[57] ABSTRACT

A particularly stable arrangement of a lamp envelope in a lamp cap is achieved by means of a metal cup which with its base faces the base of the lamp cap and is connected in the lamp cap so that its free edge engages the lamp envelope. The metal cup has an aperture in its base along the edge of which the cup has oppositely located lugs facing the base of the lamp cap and bearing against a pinch of the lamp envelope.

5 Claims, 1 Drawing Figure

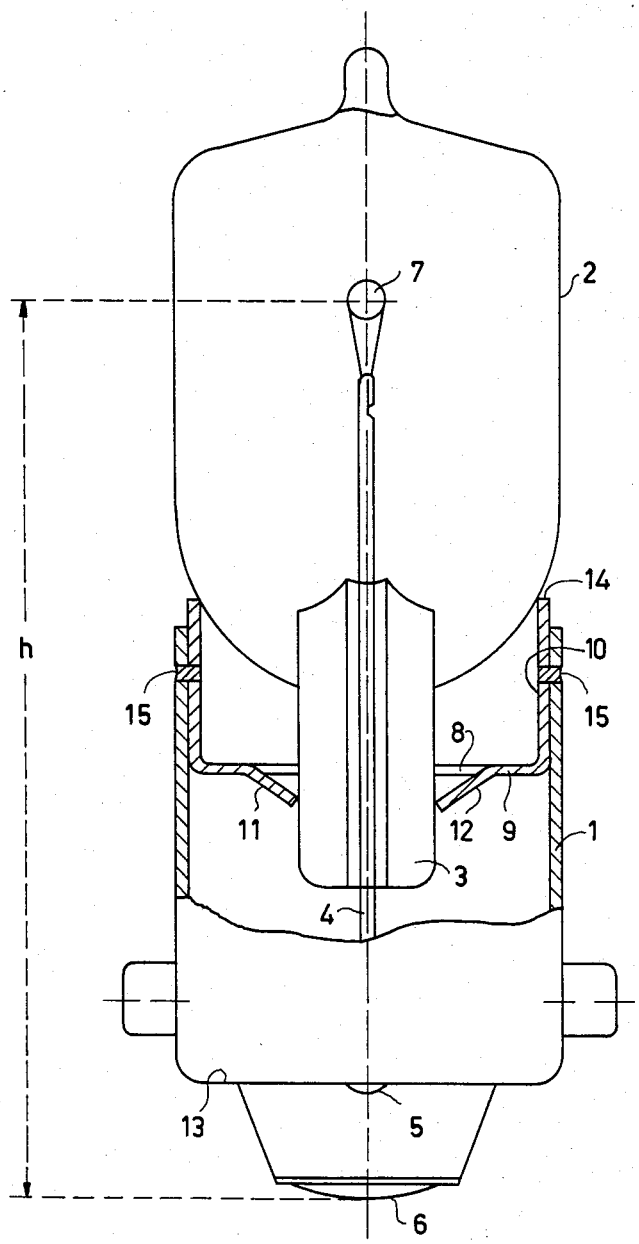
7
2
14
h
10
15
15
8
11
12
9
1
3
4
13
5
6

ELECTRIC LAMP HAVING A LAMP CAP WHICH IS CONNECTED WITHOUT CEMENT

The invention relates to an electric lamp having a substantially metal lamp cap and a glass lamp envelope which is secured in the lamp cap without cement, which lamp envelope is sealed at one end by means of a pinch through which supply conductors extend from contacts on the lamp cap to an electric element accommodated inside the lamp envelope, the pinch of the lamp envelope extending through an aperture in the bottom of a metal cup, said cup being secured in the lamp cap and having along the edge of said aperture in its bottom oppositely-located lugs facing the base of the lamp cap and bearing against the pinch of the lamp envelope. Such a lamp is known from European patent application No. 0024363.

In the known lamp the metal cup is incorporated in the lamp cap so that its bottom faces the lamp envelope. The lugs at the bottom of the metal cup thus extend into said cup inwards and engage in a clamping manner behind a respective projection on the surface of the pinch of the lamp or engage the pinch flatly. In both cases the metal cup engages with its bottom the lamp envelope at the area where the lamp envelope has its pinch, i.e. at a short distance from the area where the lugs bear against the pinch.

The small thickness of the pinch of electric lamps (usually between 2 and 6 mm) involves that oppositely-located lugs punched out of the bottom of the metal sleeve have a small length.

Notably in very small lamps, that is to say lamps which have to be provided with a lamp cap, for example, a Swan or an Edison lamp cap, having a diameter from 9 to 14 mm or less, it is very difficult to shape the pinch of the lamp envelope with such an accuracy that a stable position of the lamp in the metal cup, and hence in the lamp cap, is obtained. It proves particularly troublesome to prevent the lamp from assuming a tilted position in the lamp cap. This is also caused by the above-mentioned small length which the lugs have when small lamps are used with consequently a thin pinch.

It is the object of the invention to provide lamps which are positioned in the lamp cap so as to be very stable.

According to the invention, this object is achieved in a lamp of the kind mentioned in the opening paragraph in that the metal cup is secured in the lamp cap with its base facing the base of the lamp cap and with its open end engaging the lamp envelope.

In the lamp according to the invention the lugs at the base of the metal sleeve thus project out of the cup. The open end of the metal cup is in a line-shaped contact with the lamp envelope and at a comparatively large distance from said contact, the lugs press against the pinch of the lamp envelope. The distance between the uppermost contacts: the open end of the cup with the lamp envelope, and the lowermost contact: the lugs with the pinch, is therefore increased by the length of the metal cup. As a result of this, the position of the lamp envelope relative to the lamp cap is very stable. This is of great importance for all those cases in which the lamps are used in a reflector, for example, in moped lamps, bicycle lamps, pocket lamps, miners' lamps, emergency lights, and the like. In the axial direction the lamp envelope is fixed relative to the lamp cap, for example, by means of the current supply conductors.

The metal cup may be connected to the lamp cap by means of solder. However, it has proved possible to obtain the connection by welding, for example, by means of spot welding or laser welding. The advantage of welding over soldering is that only a very local, very short-lasting heating of the metal parts to be connected is necessary.

An attractive aspect of the lamp according to the invention having a welded or soldered joint between the metal cup and the lamp cap is that the metal cup, while engaging the lamp envelope with its free edge, can be connected to the lamp cap in such manner that the electric element has a previously determined distance to the lamp cap. The distance to the lamp cap can be measured, for example, to the, or one of the, electric contacts on the lamp cap.

The electric element of the lamp may be a filament or a pair of electrodes. In the former case the lamp envelope generally contains inert gas or inert gas with a regenerative gas, for example, hydrogen bromide. In the latter case the lamp envelope contains an ionizable filling, for example, a rare gas and mercury, possibly with one or more halides.

The lamp envelope may be of a glass having a very high $SiO_2$ content, for example 95% by weight or more, for example quartz glass, or may be a hard glass, which in general has an $SiO_2$ content of 80 to 90% by weight, for example, alkali aluminoborosilicate glass.

The metal cup may be manufactured from metals which are used for the manufacture of lamp caps, for example aluminium, either with or without nickel plating, or brass.

The length of the metal cup can be established easily for any type of lamp in a small series of experiments. The length is mainly associated with the shape of the lamp envelope, the height of the lamp cap and the desired light center length of the lamp. In lamps having a BA9 lamp it has been found that a cup having a length from base to upper edge of 3 mm provides a stable arrangement of the lamp envelope in the lamp cap.

An embodiment of a lamp according to the invention is shown in the drawing. The FIGURE is a side elevation of an electric incandescent lamp showing the lamp cap as a partial longitudinal cross-sectional view and the metal cap fully as a longitudinal sectional view.

In the FIGURE, a lamp envelope 2 is secured in a substantially metal Swan lamp cap 1 without cement. The lamp envelope 2 is sealed at one end by means of a pinch 3 through which current supply conductors 4 extend from the contacts 5 and 6 of the lamp cap to an electric element 7, a filament which is arranged inside the lamp envelope 2.

The pinch 3 of the lamp envelope projects through an aperture 8 in the base 9 of a metal cup 10. Along the edge of said aperture 8 the cup 10 at its base 9 has oppositely-located lugs 11 and 12 which face the base 13 of the lamp cap 1 and hence project below the base 9 of the metal cup 10. The lugs 11 and 12 bear against the pinch 3.

The base 9 of the metal cup 10 faces the base 13 of the lamp cap 1 and the edge 14 at the open end of the cup engages the lamp envelope 2 and has therewith a line-shaped contact which is present at a comparatively large distance from the contact between the lugs 11, 12 and the pinch 3. The lamp envelope 2 consequently has a very stable position in the metal cup 10 and in the lamp cap 1, since the metal cup 10 and the lamp cap 1 are connected together by means of welds 15. Example:

The lamp shown in the drawing is a halogen incandescent lamp which consumes a power of 3 W at a voltage of 6 V. The current supply conductors of the lamp consist of molybdenum. They are locally coated with alkali aluminoborosilicate glass and at the area of said coating are embedded in the pinch of the lamp envelope which consists of the same kind of glass. The lamp is filled with $7\times10^5$ Pa of krypton to which 0.1 % by volume of $CH_2Br_2$ has been added. From this hydrogen bromide is formed when the lamp is operated.

The lamp envelope has a largest outside diameter of 9 mm, the metal cup of 8.7 mm. The cup is made from CuZn 63/37 (weight ratio) with a nickel coating. The metal cup has a length of 4 mm, the projecting lugs excluded, and provides a very stable position of the lamp envelope in the lamp cap. The lamp cap is a BA9 cap of the same material as the cup.

What is claimed is:

1. An electric lamp which comprises:

a substantially metal cup, a substantially metal lamp cap and a glass envelope, said lamp cap having a base, said envelope being secured in said lamp cap without cement, said lamp envelope being sealed at one end by means of a pinch through which current supply conductors extend from contacts on said lamp cap to an electric element disposed inside said lamp envelope, said cup having an open end and a base, said open end being opposite said base, said base having an aperture therein, said pinch of said lamp envelope extending through said aperture in said base of said metal cup, said cup being secured in said lamp cap and having along the edge of said aperture oppositely-located lugs which face said base of said lamp cap and bear against said pinch of said lamp envelope, said open end of said metal cup being in line contact with said lamp envelope, said metal cup being secured in said lamp cap with said base thereof facing said base of said lamp cap and engaging said lamp envelope with said open end thereof.

2. An electric lamp as claimed in claim 1 wherein said contact of said lugs and said line contact with said lamp envelope are disposed in spaced relation.

3. An electric lamp as claimed in claim 1, wherein said metal cup is secured in said lamp cap by welding.

4. An electric lamp as claimed in claim 1, further including means securing said metal cup in said lamp cap in such manner that said electric element is disposed at a predetermined distance from said lamp cap.

5. An electric lamp as claimed in claim 2, further including means securing said metal cup in said lamp cap in such manner that said electric element is disposed at a predetermined distance from said lamp cap.

* * * * *